United States Patent [19]

Rohr et al.

[11] Patent Number: 4,520,851

[45] Date of Patent: Jun. 4, 1985

[54] GRIPPER FOR INSERTING THE WEFT IN A RAPIER WEAVING MACHINE

[75] Inventors: Willy Rohr, Hinwil; Kurt Wollgarten, Rüti; Rudolf Vogel, Grüt, all of Switzerland

[73] Assignee: Sulzer Brothers Limited, Winterthur, Switzerland

[21] Appl. No.: 595,722

[22] Filed: Apr. 2, 1984

[30] Foreign Application Priority Data

Apr. 18, 1983 [EP] European Pat. Off. ..... 83810160.8

[51] Int. Cl.[3] ..... D03D 47/20

[52] U.S. Cl. ..... 139/448

[58] Field of Search ..... 139/447, 448

[56] References Cited

U.S. PATENT DOCUMENTS 4,371,008 2/1983 Freisler .

4,417,606 11/1983 Corain ..... 139/448

FOREIGN PATENT DOCUMENTS 2642809 4/1977 Fed. Rep. of Germany .

2907540 9/1979 Fed. Rep. of Germany .

3033201 3/1981 Fed. Rep. of Germany .

*Primary Examiner*—Henry S. Jaudon

*Attorney, Agent, or Firm*—Werner W. Kleeman

[57] ABSTRACT

The taker-gripper has a longitudinally translatable clamping tongue with a clamping tongue head. The latter is pressed by a spring into a clamping hook having a first diagonally oriented or inclined clamping flank. The weft or filling thread is thereby firmly gripped and pulled through the weaving shed. The clamping hook has a further clamping flank oriented diagonally or at an inclination in reverse relation to the diagonal or inclined orientation of the first clamping flank. A correspondingly located inclined or diagonal flank of the clamping tongue head slidingly engages the further clamping flank of the clamping hook as the clamping tongue opens. As the parts of the gripper move into the open position, a pivoting motion of the clamping tongue about a pivot pin is generated by an eccentric engagement of a tension band at the clamping tongue in relation to the pivot pin. In this manner, the open position is rapidly attained and the gripped thread or yarn or the like is quickly released independently of its characteristics, e.g. thickness or texture. The projecting weft thread ends are thereby made shorter and more uniform.

7 Claims, 7 Drawing Figures

GRIPPER FOR INSERTING THE WEFT IN A RAPIER WEAVING MACHINE

BACKGROUND OF THE INVENTION

The present invention broadly relates to rapier or gripper weaving machines or looms and, more specifically, pertains to a new and improved construction of a gripper for inserting the weft or filling thread in a rapier or gripper weaving machine.

Generally speaking, the gripper of the present invention is provided with a clamping or grip hook for clamping a weft or filling thread and an associated clamping tongue translatable or displaceable in a gripper frame in the longitudinal direction of the gripper under the action of a spring. A clamping tongue head and one clamping flank, defining a major flank, of the clamping hook are oriented at an angle or inclination to the longitudinal direction of the gripper.

In a prior art gripper device or gripper of the aforementioned type which is known from the German Patent Publication No. 3,033,201 corresponding to U.S. Pat. No. 4,371,008, granted Feb. 1, 1983, the clamping tongue is mounted in the gripper frame such that when it is retracted, i.e. opened, the clamp formed by the clamping tongue head and the clamping hook can only be translated or displaced in the longitudinal direction of the gripper device. This has the disadvantage that a relatively great retraction motion of the clamping tongue is required in order to release the firmly gripped weft thread from the thread clamp. This is especially true for thicker yarns or threads or for yarns or threads having irregular or rough surfaces, e.g. for yarns or threads with variable thickness.

SUMMARY OF THE INVENTION

Therefore, with the foregoing in mind it is a primary object of the present invention to provide a new and improved construction of a gripper for inserting the weft or filling thread in a rapier gripper weaving machine which does not have associated with it the aforementioned drawbacks and shortcomings of the prior art constructions.

Another and more specific object of the present invention aims at providing a new and improved construction of a gripper of the previously mentioned type in which a further, minor, clamping hook flank is diagonally oriented in reverse relation to the diagonal orientation of a first, major, clamping hook flank with respect to the longitudinal direction of the gripper and forms guide means for a clamping tongue head during an opening motion of a clamping tongue.

Yet a further significant object of the present invention aims at providing a new and improved construction of a gripper for inserting the weft or the like in a rapier or gripper weaving machine of the character described, which gripper is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the gripper of the present invention is manifested by the feature that, the other or minor flank of the clamping hook is oriented at an inclination to the longitudinal direction of the gripper which is of opposite or reverse sense to the inclination of the one major clamping flank, and the minor flask forms guide means for guiding the clamping tongue head during the opening motion of the clamping tongue.

This makes it possible to superpose a slight pivoting or rocking motion upon the retraction motion of the thread clamp arising during the opening motion of the thread clamp. The clamping tongue head is moved away from the clamping flank of the clamping hook more rapidly and in a shorter path by the resulting motion of the clamping tongue.

This avoids the production of weft thread ends of different lengths upon opening of the clamp at the end of the weft insertion, for instance in the production of mixed fabrics containing yarns or threads of different type, e.g. thickness or texture. The result can, in fact, be obtained that the weft thread ends have practically all the same length independently of the yarn properties, for instance independently of whether a thicker or thinner or a rougher or smoother weft thread is inserted or shot into the weave. Furthermore, the time required for the full release of the weft thread or the like from the thread clamp is reduced and the retraction path of the clamping tongue can be made shorter.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
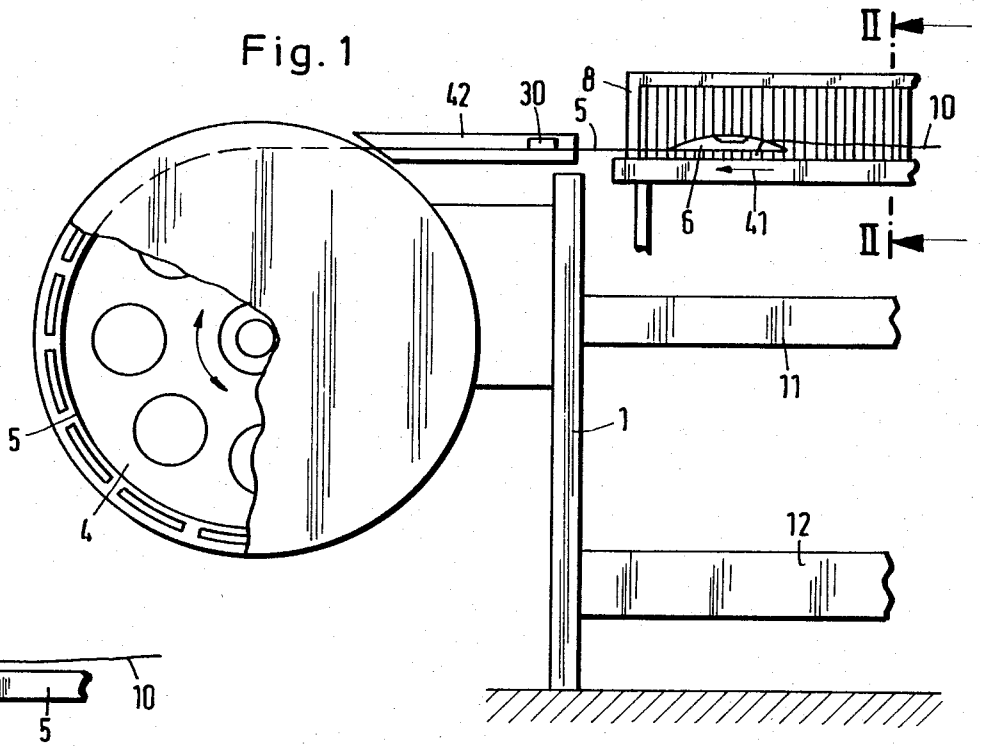
FIG. 1 is a partial schematic representation of a front view of a rapier or gripper weaving machine or loom employing the invention.
Figure 2:
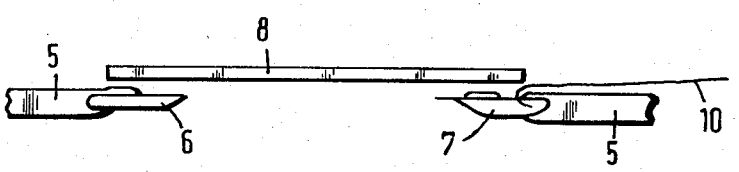
FIG. 2 is a schematic representation of the weft insertion components on an enlarged scale.

Describing now the drawings, it is to be understood that to simplify the showing of the drawings, only enough of the structure of the gripper and the related weaving machine or loom have been illustrated therein as is needed to enable one skilled in the art to readily understand the underlying principles and concepts of this invention. The depicted rapier or gripper weaving machine shown in FIGS. 1 and 2 will be seen to comprise a weaving machine frame 1, a breast beam 11 and a median beam or girder 12. The weft insertion mechanism comprises two drive wheels 4 arranged at opposite sides of the weaving machine, each of which carries a flexible insertion band or tape 5. Only the catch side mechanism is shown in FIG. 1. A supply or bringer-gripper 7 for delivering the weft or filling thread 10 into the weaving shed is fastened to the insertion-side insertion band or tape 5. A take-in or taker-gripper 6 is mounted on the catch-side insertion band or tape 5. In the center of the weaving shed, the taker-gripper 6 takes in the weft or filling thread 10 and pulls it through the second half of the shed.

This take-in or taker-gripper 6 comprises a gripper frame 13, which can be, for instance, made of aluminum. The gripper frame 13 comprises a base plate or panel 14 and two side walls 15 and 16. A pinch or clamping tongue 17, defining a gripper pivot arm, is mounted in the gripper frame 13 to be translatable or displaceable in the direction of the double-headed arrow 21. A forked or bifurcated portion 22 of the clamping tongue 17 surrounds a pivot bearing or pin 18 or the like fastened to the base plate or panel 14 and continues to the left in FIG. 3 as a traction or retraction arm 24. The clamping tongue 17 is therefore pivotable about the pivot pin 18 in the direction of the double-headed arrow 23.

Figure 3:
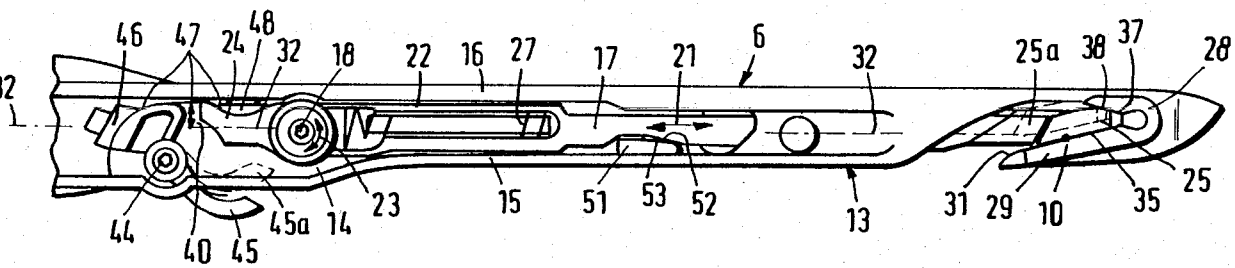
FIG. 3 is a fragmentary schematic top plan view of a gripper of the weaving machine.
Figure 4:
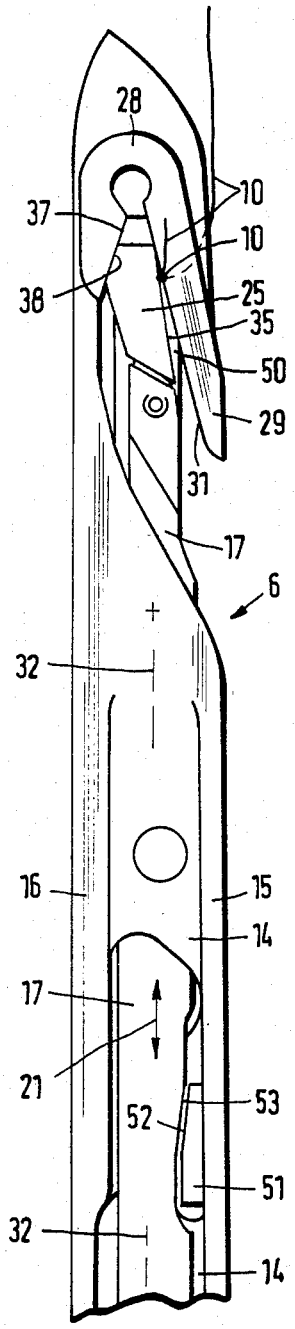
FIGS. 4 and 5 are two detailed views in different positions of the gripper and on a further enlarged scale.
Figure 5:
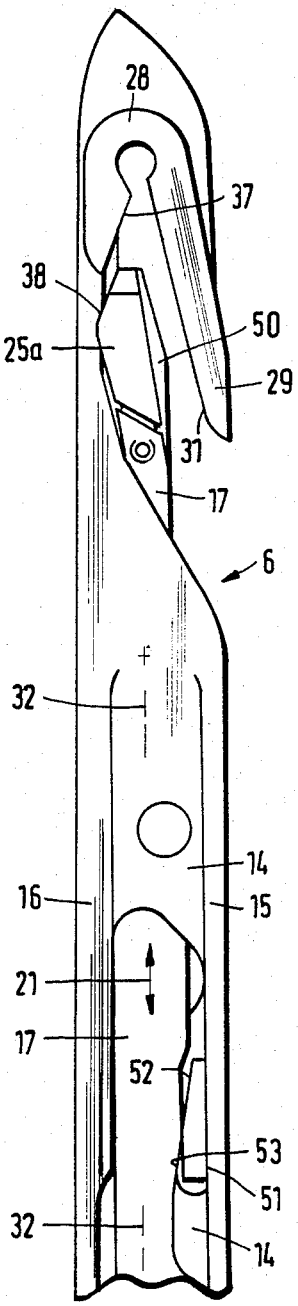

The clamping tongue 17 has, at its right end as seen in FIG. 3, a pinch or clamping tongue head 25 mounted on a connecting plate 50 and shown on an enlarged scale in FIGS. 4 and 5 which may, for instance, be made of hard metal. The clamping tongue head 25, together with the entire clamping tongue 17, is pressed into a clamping hook 28 mounted on the gripper frame 13 by the action of a compression or pressure spring 27. The clamping hook 28 has a free end 29, the inclined so-called major flank 31 of which is oriented diagonally or at angle to the longitudinal direction of the gripper 6 or the longitudinal axis 32 thereof. A correspondingly diagonally or inclined oriented flank 35 formed on the clamping tongue head 25 cooperates with the major flank 31 of the clamping hook 28.

The clamping hook 28 has a further, so-called minor flank 37 oriented diagonally or at an angle to the longitudinal axis 32 of the gripper 6 in a reverse sense to that of the diagonal or inclined major flank 31. This minor diagonal or inclined flank 37 cooperates with a correspondingly inclined or diagonally oriented flank 38 of the clamping tongue head 25.

In the clamping position of the components or parts illustrated in FIG. 3, the weft or filling thread 10 is firmly gripped between the flanks 31 and 35 and is pulled towards the catch side or to the left of FIG. 1 in the direction of the arrow 41. As soon as the gripper 6 travels into a guide member 42, a stop member or abutment 45 pivotably mounted on the base plate or panel 14 at location 44 is pivoted by a fixed ramp or cam 30, schematically indicated in FIG. 1, into the position **45*a* represented in broken or phantom lines. This pulls a retraction band or element 47 fastened to the stop member 45 at location 46 to the left in FIG. 3**.

The retraction band or element 47 is fastened at location 48 to the traction or retractor arm 24 of the clamping tongue 17 eccentrically in relation to the pivot pin 18, thus producing a lever arm 40. This shifts the clamping tongue 17 to the left and simultaneously imparts a slight counterclockwise rotation or rocking to it due to the eccentric force of the retraction band or element 47. Thus the clamping tongue head 25 arrives in the open position **25*a* indicated in broken or phantom lines in FIG. 3 and the flanks 37 and 38** slide upon one another.

The diagonal or inclined orientation of these two flanks 37 and 38 makes it possible to impart a rotative motion to the clamping tongue 17 about the pivot pin 18 during leftward translation or displacement of the clamping tongue 17. The clamping flanks 31 and 35 thereby arrive in the open position more rapidly and the weft yarn or thread 10 is more rapidly released, even should it be a thicker weft yarn.

Additionally, a wedge 51 or equivalent structure having a tapered or inclined flank or ramp 52 is mounted at the side wall 15 to cooperate with a corresponding diagonal or inclined flank or ramp 53 formed on the clamping tongue 17. During the leftward translation of the clamping tongue 17, the pivoting motion about the pivot pin 18 is reinforced by the action of the wedge 51. This wedge 51 also forms a counteracting shoe or counter bearing member in relation to the flank 37 of the clamping hook 28 which prevents vibrations or oscillations of the clamping tongue 17 during its leftward translation and its superposed pivoting motion about the pivot pin 18.

Figure 6:
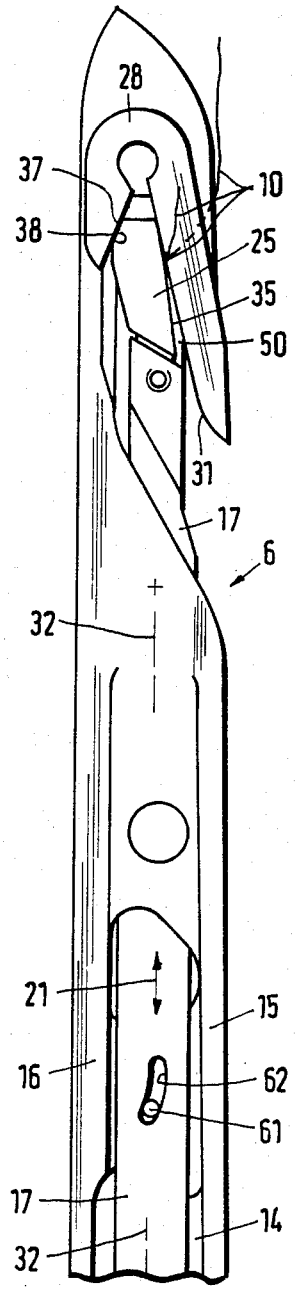
FIGS. 6 and 7 are two views analogous to the views of FIGS. 4 and 5 and showing an alternate embodiment.
Figure 7:
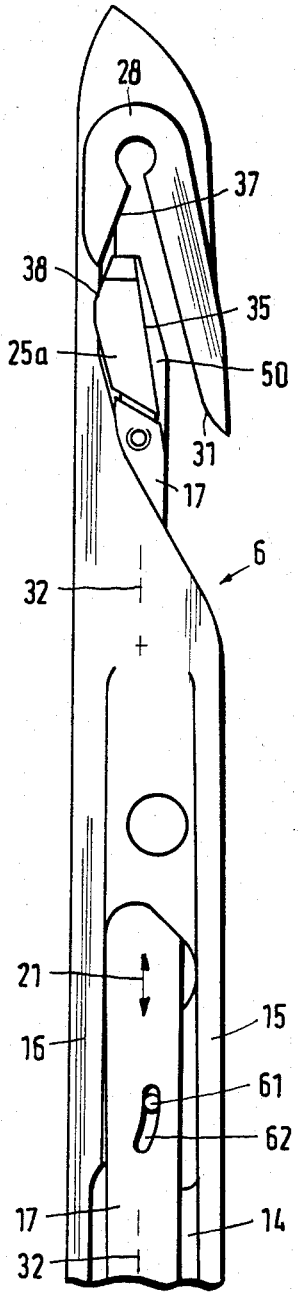

In the embodiment represented in FIGS. 6 and 7 a guide pin 61 is fastened for instance to the base plate or panel 14 to cooperate with a curved or inclined slot 62 in the clamping tongue 17. If the clamping tongue 17 is moved out of the clamping position shown in FIG. 6 downward into the open position shown in FIG. 7 in the direction of the arrow 21, then the upper end of the curved or inclined slot 62 arrives over the guide pin 61 imposing a counterclockwise pivoting motion on the clamping tongue 17 during such downward motion. The clamping tongue head 25 arrives in the open position **25*a* shown in FIG. 7, whereby the flanks 37 and 38 slide upon one another. Of course, the guide pin 61 can be provided at the clamping tongue 17, in which case the curved or inclined slot 62 is provided at the base plate or panel 14 of the gripper frame 13**.

In a further embodiment, the wedge 51 is omitted. Since the tension force directed towards the left in FIG. 3 and exerted by the retraction band or element 47 at location 48 is eccentric in relation to the pivot pin 18 and thus produces a lever arm 40, there is still a counterclockwise torque or rotational moment about the pivot pin 18 in FIG. 3. The clamping tongue head 25 is therefore moved into the open position **25*a* with a mutual sliding motion of both flanks 37 and 38** and therefore over the shortest path and in the shortest time.

An embodiment is also possible in which the retraction band or element 47 engages the pivot pin 18 at the longitudinal or clamping tongue axis 32 and therefore concentrically. Then the wedge 51 is necessary in order to assure that the clamping tongue 17 performs, in addition to its longitudinal motion, a pivoting motion about the pivot pin 18 corresponding to the arrow 23. Instead of the wedge 51, a magnet mounted on the side wall 16 can also be used to pull the clamping tongue 17 upwards in FIG. 3 during its motion to the left in FIG. 3 and thereby impart a pivoting motion to the clamping tongue 17.

The clamping tongue 17 can also be made of an elastic material, for instance plastic. The clamping tongue head 25 can then be held in the clamping position of FIG. 4 by a prestressing or preloading of the clamping tongue 17. When the clamping tongue 17 is retracted in order to open the gripper, the flanks 37 and 38 mutually slide over one another under the prestressing action, so that at least the clamping tongue head 25 of the clamping tongue 17 is subjected to a pivoting motion about the pivot pin 18, in other words a lateral or transverse motion with respect to the longitudinal axis 32, in addition to the longitudinal motion.

It is of decisive importance that the clamp formed by the components 29 and 25 have a pivoting motion about the pivot pin 18 superposed upon the sliding motion of the clamping tongue 17 during the opening motion.

Correspondingly, the supply or bringer-gripper 24 can also be provided with clamping components having diagonally oriented or inclined flanks for generating a pivoting motion superposed upon the translational pull motion.

While there are shown and described present preferred embodiments of the invention, it is to be distinctly understood that the invention is not limited thereto, but may be otherwise variously embodied and practiced within the scope of the following claims. Accordingly,

What we claim is:

1. A gripper for weft thread insertion in a rapier weaving machine and having a longitudinal direction, comprising:

a gripper frame;

a clamping hook for engaging a weft thread;

a clamping tongue operatively associated with said clamping hook and having an opening motion;

spring means acting upon said clamping tongue;

said clamping tongue being translatable in said gripper frame in said longitudinal direction of the gripper under the action of said spring means;

said clamping tongue having a clamping tongue head;

said clamping hook having a major flank and a minor flank;

said major flank of the clamping hook and said clamping tongue head of the clamping tongue being both oriented at a first inclination to the longitudinal direction of the gripper;

said minor flank of the clamping hook being oriented at a second inclination to the longitudinal direction of the gripper which is of opposite sense to said first inclination; and said minor flank forming guide means for guiding the clamping tongue head during said opening motion of the clamping tongue.

2. The gripper as defined in claim 1, further including:

means for pivotably mounting said clamping tongue at said gripper frame;

said clamping tongue forming a gripper pivot arm carrying said clamping tongue head; and a tapered wedge mounted on said gripper frame and operatively engaging said gripper pivot arm during said opening motion of the clamping tongue.

3. The gripper as defined in claim 1, further including:

means for pivotably mounting said clamping tongue at said gripper frame.

4. The gripper as defined in claim 3, further including:

a tapered wedge mounted on said gripper frame to operatively engage said clamping tongue during said opening motion thereof.

5. The gripper as defined in claim 3, further including:

a guide pin and an inclined slot;

said guide pin being mounted at said clamping tongue;

said inclined slot being provided at said gripper frame; and said guide pin operatively engaging said inclined slot to induce said pivoting motion of the clamping tongue upon said opening motion of the clamping tongue.

6. The gripper as defined in claim 3, further including:

a guide pin and an inclined slot;

said guide pin being mounted at said gripper frame;

said inclined slot being provided at said clamping tongue; and said guide pin operatively engaging said inclined slot to induce said pivoting motion of the clamping tongue upon said opening motion of the clamping tongue.

7. The gripper as defined in claim 3, further including:

a pivot bearing provided at said clamping tongue;

said clamping tongue being provided with a retractor arm; and a retraction element for operating the clamping tongue engaging said retractor arm of the clamping tongue eccentrically in relation to said pivot bearing thereof.

* * * * *